United States Patent [19]

Schreder

[11] Patent Number: 4,716,277

[45] Date of Patent: Dec. 29, 1987

[54] ELECTRIC HOTPLATE

[75] Inventor: Felix Schreder, Oberderdingen, Fed. Rep. of Germany

[73] Assignee: E.G.O. Elektro-Geräte Blanc und Fischer, Fed. Rep. of Germany

[21] Appl. No.: 800,516

[22] Filed: Nov. 21, 1985

[30] Foreign Application Priority Data

Nov. 29, 1984 [DE] Fed. Rep. of Germany ..... 3443529

[51] Int. Cl.[4] ..... H05B 3/70

[52] U.S. Cl. ..... 219/449; 219/459; 219/460; 219/513; 337/321

[58] Field of Search ..... 219/449, 443, 445, 446, 219/447, 448, 458, 459, 460, 461, 466, 467, 450, 513, 542; 337/321, 119

[56] References Cited

U.S. PATENT DOCUMENTS

| | | | |
|---|---|---|---|
| 1,659,774 | 2/1928 | Hicks | 219/459 |
| 1,729,673 | 10/1929 | Kercher | 219/467 |
| 2,255,500 | 9/1941 | Blaha | 219/464 |
| 2,321,815 | 6/1943 | Hull | 177/311 |
| 3,025,378 | 3/1962 | Sadell | 219/449 |
| 3,301,170 | 1/1967 | Beasley | 219/449 |
| 3,317,709 | 5/1967 | Beasley | 219/449 |
| 3,356,832 | 12/1967 | Kjellberg | 219/413 |
| 3,581,058 | 5/1971 | Romano | 219/513 |
| 4,164,175 | 8/1979 | Burstein | 219/460 |

FOREIGN PATENT DOCUMENTS

| | | | |
|---|---|---|---|
| 570736 | 2/1933 | Fed. Rep. of Germany . | |
| 663811 | 8/1938 | Fed. Rep. of Germany . | |
| 683643 | 10/1939 | Fed. Rep. of Germany | 219/459 |
| 913662 | 6/1954 | Fed. Rep. of Germany . | |
| 1865604 | 1/1963 | Fed. Rep. of Germany . | |
| 1250025 | 9/1967 | Fed. Rep. of Germany . | |
| 2850389 | 5/1980 | Fed. Rep. of Germany . | |
| 3005867 | 8/1981 | Fed. Rep. of Germany . | |
| 315355 | 9/1956 | Switzerland . | |
| 274254 | 7/1927 | United Kingdom . | |
| 798922 | 7/1958 | United Kingdom | 219/513 |

*Primary Examiner*—E. A. Goldberg
*Assistant Examiner*—Teresa J. Walberg
*Attorney, Agent, or Firm*—Steele, Gould & Fried

[57] ABSTRACT

A large electric hotplate for restaurants and the like is heated by tubular heaters, which are placed in slots on the bottom of a cast hotplate body. An insulation with metal cover plates and a lower plate dish ensures the necessary pressing and thermal insulation. A sensor tube is placed on the outside of the downwardly projecting outer edge of the hotplate body on either side of the hotplate, said sensor tube being connected to a thermostat supplying the tubular heaters by means of several contacts.

8 Claims, 5 Drawing Figures

ELECTRIC HOTPLATE

BACKGROUND OF THE INVENTION

The present invention relates to an electric hotplate particularly for commercial use in restaurants and the like, with a hotplate body made from cast material and below it heating resistors positioned in substantially spirally arranged slots.

Such hotplates, which are normally referred to as large hotplates, are used in the kitchens of restaurants, canteens, ships, etc. and are subject to increased loading and stressing. They are frequently used uninterrupted for twelve hours and more and are consequently thermally highly stressed and are exposed to increased contamination by spilled or splashed cooking products. They therefore require frequent cleaning, which has hitherto taken place with very violet means and media, e.g. a powerful water jet. Nevertheless a high degree of efficiency, as well as excellent adjustability and controllability are important.

Hitherto large hotplates have been constructed in the same way as domestic hotplates, i.e. with heating resistors in the form of heater coils embedded in an embedding material in slots on the bottom of the cast material hotplate body (cf. e.g. DE-OS (German Offenegungsschrift) 24 22 625).

It is already known to heat electric hotplates with tubular heaters, which are pressed onto the bottom of a disc-like plate, i.e. a plate which is smooth on its underside (DE-OS No. 30 33 828). It is also known from DE-OS No. 25 49 006 to use tubular heaters for heating convection heaters, the tubular heaters being pressed into slots of cast parts. As can be gathered from German Utility Model No. 18 21 380, such devices are also used for heating boilers. However, in that case special measures are taken in order to enclose the tubular heater firmly in the material of the basic body and to press tubular heater into intimate contact therewith. In addition, the slots have a very wide spacing, a uniform heating depending on heat conduction in the basic body.

SUMMARY OF THE INVENTION

The object of the present invention is to provide a large hotplate which, despite increased reliability with respect to robust handling, particularly during cleaning, operates with a high level of efficiency and has a long service life.

According to the invention, this problem is solved in that the heating resistors are located in tubular heaters with a metal casing and the metal casing is firmly coupled over a large area to the slot bottom and the ribs between the slots.

Through the use of tubular heaters in place of uncased heater coils embedded in an insulating material, protection against moisture is increased, which is particularly advantageous with the higher voltages frequently used in commercial enterprises and the increased exposure to moisture there due to cleaning with a large amount of liquid. Thus, no special measures have to be taken for pressing the tubular heaters against the hotplate bottom and for maintaining this pressing effect, because the tubular heaters are well guided in the slots. The efficiency is extremely good, although the tubular heaters do not have to be firmly pressed into the slots and consequently do not contact the hotplate body over the whole available area. Due to the fact that the ribs surround the tubular heater over three quarters of its circumference, the heat transferred to the hotplate body is excellent and is comparable with the hitherto known large hotplates, which could not be achieved in the case of tubular heaters pressed against a smooth plate. The tubular heaters are well guided in the slots and to a limited extent can be adapted to different thermal expansions, without clicking and squeaking noises. The frequently used unsuitable cleaning agents can also not lead to the penetration of moisture to the heating resistors.

Preferably the thickness of the ribs and particularly the spacing between the tubular heaters is smaller than the tubular heater diameter. Thus, the tubular heaters are relatively closely juxtaposed and despite a high heating surface loading, the loading of the individual tubular heaters can be kept low. The dimensions of the slot should advantageously only be slightly larger than the diameter of the tubular heater, so that the coupling is also good in the vicinity of the ribs.

In the case of an angular, preferably square or rectangular hotplate, the ribs can be interrupted at the corners. This facilitates the insertion of tubular heaters into the slots and provides a certain expansion space in this area, so that the tubular heaters can compensate thermal expansions with respect to the hotplate. Moreover, the bending of the tubular heaters need not so precisely correspond with the contour of the slots into which the tubular heaters are placed.

The underside of the heated electric hotplate zone can be covered by a metallic cover plate, which preferably presses the tubular heaters onto the slot bottom. The slot depth should correspond as closely as possible to the tubular heater diameter, so that the cover plate passes as close as possible to the slots and also forms a rear thermal closure with the ribs, so that virtually the entire circumference of the tubular heater is covered by a metal part, which is in thermal contact with the hotplate body.

The bottom of the electric hotplate can be provided with a thermal insulation, which is preferably located in a lower cover plate shell. It can be a relatively loose and mechanically not very strong, but thermally highly insulating material. This material should be chosen and arranged in such a way that even in the case of inappropriate cleaning substances and procedures it does not absorb moisture. However, this would only briefly impair its thermal insulating property, because this moisture would immediately evaporate out again. There is certainly no fear of the electrical security being impaired.

The cover plate shell can be supported on the underside of an intermediate plate, which is preferably separated from the cover plate by a thermal insulation layer. This intermediate plate can e.g. be connected by means of four screws in the corners of the hotplate to the hotplate body and consequently the complete unit is held together.

Particular significance is attached in the case of large hotplates to good conrollability or regulatability. It is a requirement that even when set to full capacity or load, they can operate without damage for many hours and maintain a very uniform temperature. It must also be ensured that on placing a cold cooking vessel thereon, the power is relatively rapidly restored and that high temperatures for the large-scale roasting or frying of food can be maintained without the hotplate being switched off by its maximum temperature limiting means. It is also required that the large hotplates can in part heat several cooking vessels in juxtaposed manner or the hotplate must also be able to operate satisfactorily if a pot is placed very eccentrically on the hotplate. It has been found that for this purpose an electric hotplate is particularly suitable, in which on a downwardly projecting edge of the hotplate body running round the heated hotplate zone a sensor tube of an expansion fluid-filled expansion system of a hotplate temperature controller or thermostat is provided. Advantageously a sensor tube is placed on the outside of two substantially facing edge portions and said two sensor tubes are interconnected by capillary tubes.

It is pointed out in this connection that DE-AS (German Auslegeschrift) 1 250 025 already discloses an electric hotplate, in which a tubular heat sensor is fitted to the downwardly projecting outer edge of the hotplate body in such a way that it surrounds more than half the circumference. In series with this sensor tube is provided a movable central sensor pressed against the cooking vessel and which interrupts the hotplate. As a result of this auxiliary sensor arranged on the hotplate edge, the expansion system of the thermostate is to acquire the additional expansion in order to move the working membrane or diaphragm into the off-position and this is also to be helped by the preferred position on the inside of the outer edge.

In the case of the presently proposed electric hotplate, the arrangement on the outside ensures that the sensor is far enough away from the heating system so as not to switch off prematurely, but still has such a good coupling therewith to react to temperature decrease of the hotplate. It is important for such large hotplates and the work of the cook, that the heating system does not switch off too early, as would be the case with a central sensor. Moreover, with the high open-circuit temperatures exhibited by these plates in practice, the expansion fluid is no longer suitable there. The arrangement of two sensors at opposite points, even when using two different cooking vessels on the same hotplate or with an extreme eccentric arrangement, still makes it possible to bring about a completely satisfactory reaction on the temperature control. It is particularly important if the edge portions provided with the sensor tubes are located on two sides of a rectangular or elongated hotplate body.

The thermostat must have at least two contacts operated by the same expansion system and switching at different temperatures and the hotplate can have at least two separately operated tubular heater portions associated with the contacts. The use of several, preferably reciprocally misadjusted contacts permits a better distribution of the high capacities (up to 5 kW) on the contacts and the mains. The normal effect associated therewith that when the thermostat operates initially the contact adjusted to the highest temperature responds and by opening and closing regulates the power, whereas the lower adjusted contact or contacts remain closed, can also occur in an advantageous manner here, but is not of greatest concern. Thus, in certain circumstances there is no need for deliberate misadjustment and instead the contacts can be set to similar temperatures without ultra-fine adjustment, so that the successive switching automatically occurs.

Advantageously the sensor tubes can be arranged in reception tubes or channels fixed to the edge. Unlike in the case of clamp or clip fastening, they are easily interchangeable there and are coupled together in a clearly defined manner. On inserting in a sensor tube, the sensor can be easily replaced, while on inserting in a channel, which is possibly curved inwards, a particularly good thermal coupling is achieved.

BRIEF DESCRIPTION OF THE DRAWINGS

The invention is described in greater detail hereinafter relative to non-limited embodiments and with reference to the attached drawings, wherein.

DETAILED DESCRIPTION OF THE PREFERRED EMBODIMENTS

Figure 1:
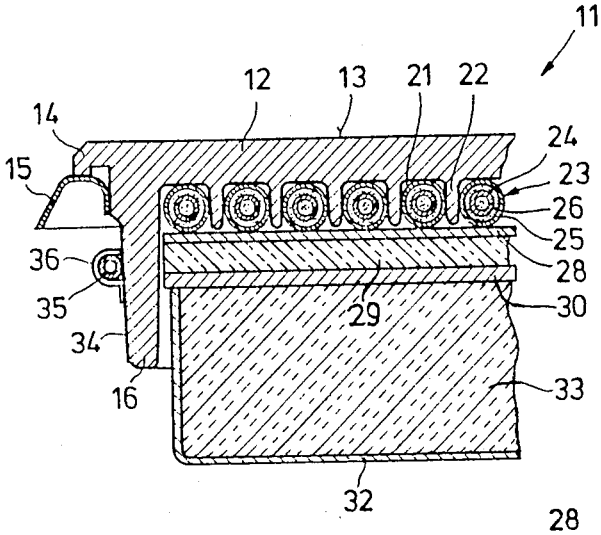
FIG. 1 is a vertical detail section through an electric hotplate.

Electric hotplate 11 has a cast iron hotplate body 12, which has an upper, planar, closed cooking surface 13 and an all-round edge flange or rim 14. Below the rim is provided a slopingly downwardly directed sheet metal ring 15, called a spillage rim, which has an inverted U or V-shaped cross-section. In the edge area, an all-round edge 16 of the hotplate body extends downwards and outwardly defines the heated region 17 of the hotplate.

Figure 2:
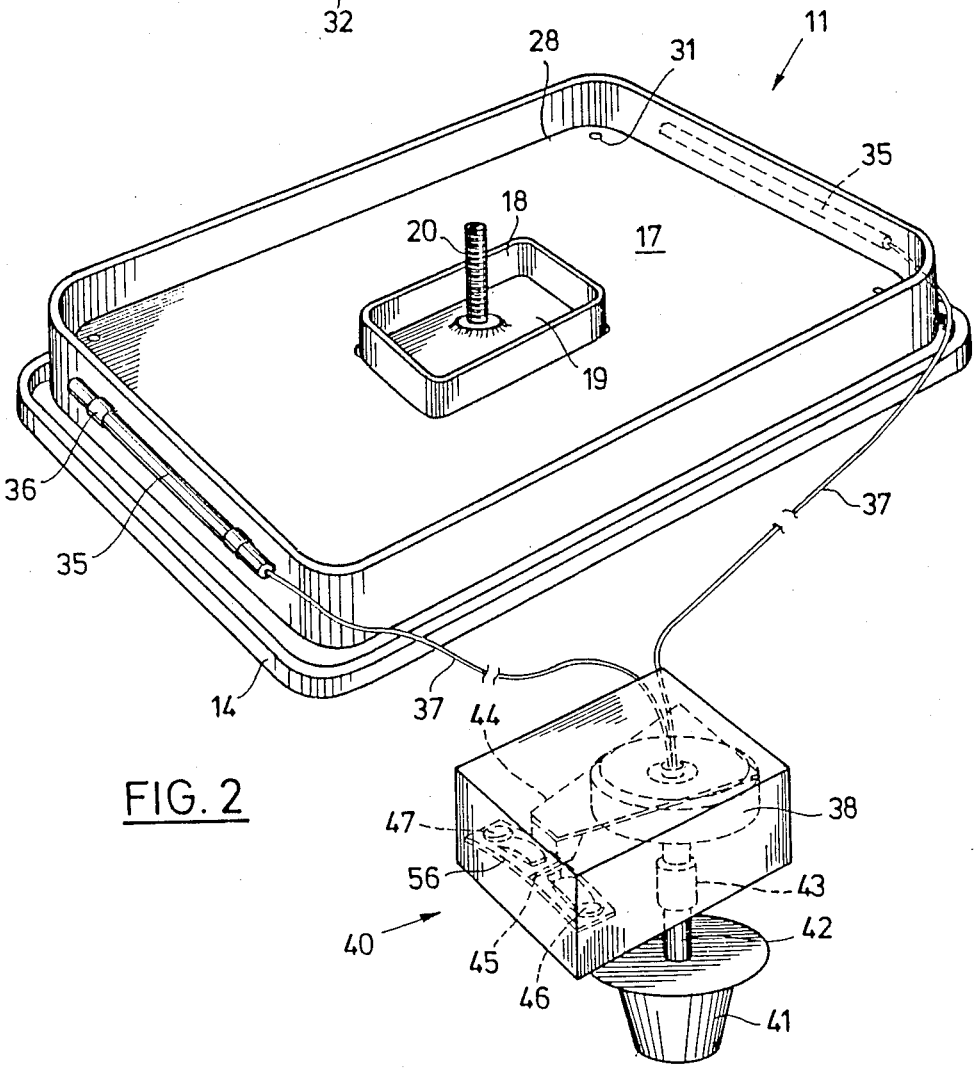
FIG. 2 is a perspective view of the bottom of an electric hotplate with its sensor arrangement and an associated thermostat, but without the cover dish and insulation.

FIG. 2 shows that the electric hotplate has a moderately elongated, rectangular basic shape, so that the heated area 17 is in the form of a quadrangular ring, because an unheated central zone 19 is defined in the center by an inner edge 18 and into which is formed an integrally cast central eye, threaded to receive a fastening bolt 20.

On the underside, hotplate body 12 is provided in the heated area 17 with slots 21, which are in each case separated by relatively narrow ribs 22 and whose transverse and height dimensions are approximately the same, so that circular tubular heaters 23 are received therein in such a way that they do not project downwards significantly beyond the ribs. In a conventional manner, the tubular heaters comprise heating resistors 24 in the form of helically wound wires, which are arranged in a mainly stainless steel casing 25 in a highly compressed embedding material 26. The tubular heaters are placed with a relatively small spacing, whereby they are only separated by ribs 22, in slots 21, so that their reciprocal spacing is much smaller than a tubular heater diameter. The tubular heaters do not have to be firmly pressed into the slots and there is also no need for precise shape adaptation of the slot to the tubular heater cross-section.

Figure 3:
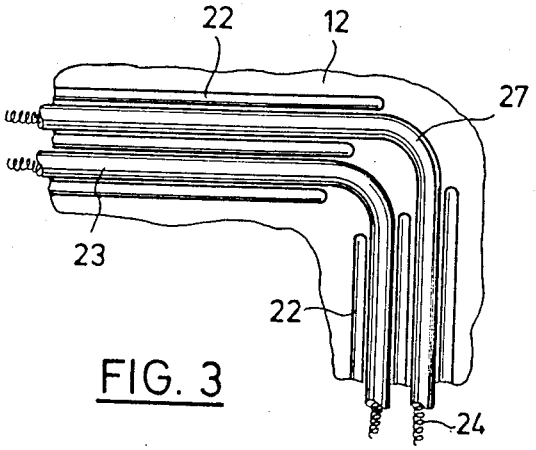
FIG. 3 is a detail view of the bottom of the hotplate body with the tubular heaters.

As can be gathered from FIG. 3, in the case of a rectangular hotplate, the ribs 22 can be interrupted at the corners, so that the tubular heater bends 27 are not in the slots and consequently the precise shape of the bend is not critical and at this point there is reserved a certain freedom of expansion. Also in the case of circular or partly rounded hotplate shapes, it is possible to have interruptions in the slots. However, advantageously most of the tubular heater length is located in the slots, in order to ensure a good thermal coupling with the hotplate body. There is no need to fill with any embedding material the space formed in the slot around the tubular heater.

FIG. 1 shows that in the case of a quadrangular hotplate 11 substantially straight tubular heaters 23 in the slots are held therein by a cover plate 28, which presses the tubular heaters against the slot bottom. The cover plate 28 is pressed upwards over an insulating layer 29 by an intermediate plate 30, which is screwed to the hotplate body by screws (not shown) in the four corners of the hotplate. The screws project through holes 31 through the cover plate 28, which is shown in FIG. 2 as a covering of the heated zone 17. Below intermediate plate 30 is provided a cover plate shell 32, which contains a thick layer of a good thermal insulation 33, e.g. in the form of silica gel. The good hotplate efficiency is further improved by the insulation.

Two tubular heat sensors 35 are fitted at two opposite points of the outside 34 of edge 16 and in the represented example an elongated, rectangular hotplate on the two narrow sides. However, they can also be fitted at other, roughly facing points, where they are fixed by clamps 36, clips, etc.

The heat sensors comprise elongated, not very thick tubes, mostly of stainless steel, to which are connected capillary tubes 37, which lead to a common expansion box 38 of a thermostat 40. In the represented example, the capillary tubes are separately led up to the expansion box 38. However, both heat sensors could be serially connected with a capillary tube. Sensors 35, capillary tubes 37 and expansion box 38 form an expansion fluid-filled thermal expansion system of thermostat 40, which is diagrammatically shown in FIG. 2. A setting spindle 42 provided with a setting knob 41 adjusts the counter abutment of expansion box 38 by means of a nut 43 and which is fitted to a pivotable operating lever 44. By means of a pressure piece, the operating lever 44 presses on the operating pressure point 45 of a snap-action switch 56, which is represented as a double snap-action switch with two separate contacts 47 located at the ends of its snap-action spring. The switching temperature of these contacts can differ slightly, so that they switch successively when, during the expansion of the expansion box the operating lever 44 is raised from the operating pressure point.

The tubular heaters 23 are provided in several, separately connectable portions, which are supplied with power by the different contacts 46, 47. However, it is also possible to provide several independent snap-action switches, e.g. three juxtaposed switches of this type, which are operated by the same expansion box 38 and preferably by means of the same operating lever 44 and switch two or three different tubular heater portions. If the hotplate is heated to above the set value, the thermostat successively switches off the tubular heater portions with a certain desired, thermal delay when the expansion fluid in the sensors 35 has become adequately heated.

Figure 4:
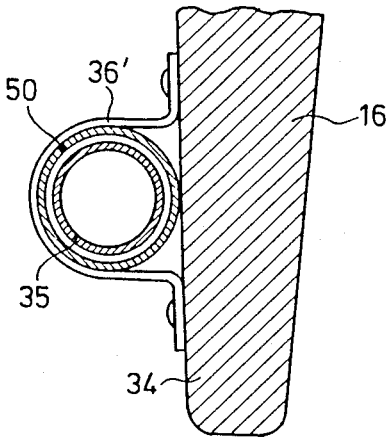
FIGS. 4 and 5 are partial sections through the edge with the sensor tube fitting.

FIG. 4 shows a variant of the fitting of the heat sensor tube 35. By means of a clip 36', a sensor protection tube 50 is fitted to edge 16 and into it is inserted the heat sensor 35. Thus, the latter is securely held, but can still be easily removed.

Figure 5:
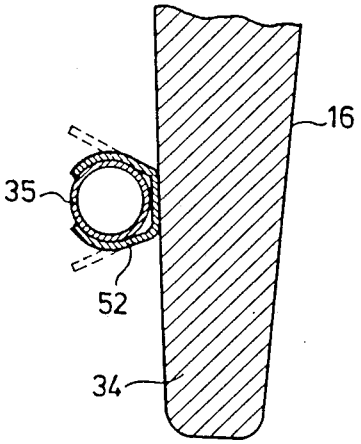

FIG. 5 shows a variant of the sensor fitting, in which a channel-shaped sheet metal part 52 is fitted to the outside 34 of edge 16, e.g. by soldering or spot welding and, as with all sensors, is disposed roughly horizontally, i.e. parallel to the cooking surface. This channel, which can have a U-shape, is placed the sensor tube 35 and the channel flanges are then at least partly bent together over the sensor tube, so that it is pressed into the channel and receives a particularly well defined position, so that there is no possibility of changes to the control characteristics through movement, but nevertheless the sensor can be removed again by bending up the channel material. The state prior to fixing sensor 35 is indicated in broken line form.

The slots can be arranged in the form of spirals, which optionally have a rectangular or square shape and can be constructed in multiple manner corresponding to the number of tubular heater portions. However, it is also possible to insert the tubular heaters in individual, concentric rings or almost closed arcs, the connection ends being correspondingly interconnected.

What is claimed is:

1. An electric hotplate, comprising:

a hotplate body of cast material, the hotplate body having cast-in-slots defined on a lower side thereof, the slots being defined between narrow ribs in the hotplate body and the slots being arranged substantially parallel to one another;

tubular heaters including electrical heating resistors embedded in an electrical heating insulating material within a tubular metal casing, the tubular heaters being arranged in the slots, the slots engaging the heaters by at least two thirds of a circumference of the tubular heaters, whereby metallic contact is provided between the metal casing and inner surfaces of the slots;

the hotplate body having a downwardly directed rim, surrounding the hotplate body;

a temperature regulator including a thermal expansion system having at least two temperature sensors, the two temperature sensors being filled with an expansion fluid and connected to an outside of the rim at two substantially facing portions of the rim and being interconnected with the thermal expansion system and with one another by capillary tubes; and, a double-contact switch responsive to the thermal expansion system and having two switch contacts operated at two temperatures by the expansion system and switching two separately-energized portions of said tubular heaters.

2. The electric hotplate of claim 1, wherein the temperature sensors include sensor tubes located on two opposite sides of the hotplate body, the hotplate body being quadrangular.

3. The electric hotplate of claim 1, wherein the rim of the hotplate body has means defining reception channels for mounting the sensor tubes.

4. An electric hotplate, comprising:

a hotplate body of cast material, the hotplate body having cast-in-slots defined on a lower side thereof, the slots being defined between narrow ribs in the hotplate body and the slots being arranged substantially parallel to one another; and, tubular heaters including electrical heating resistors embedded in an electrical heating insulating material within a tubular metal casing, the tubular heaters being arranged in the slots, the slots engaging the heaters by at least two thirds of a circumference of the tubular heaters, whereby metallic contact is provided between the metal casing and inner surfaces of the slots, the slots being arranged in a rectangular configuration with corners, the tubular heaters being bent at the corners, the ribs in the hotplate body defining the slots being interrupted at the corners.

5. The electric hotplate of claim 4, wherein the tubular heaters are spaced at a distance smaller than a diameter of the tubular heaters.

6. The electric hotplate of claim 4, wherein the slots are only slightly larger than a diameter of the tubular heaters.

7. An electric hotplate, comprising:

a hotplate body of cast material, the hotplate body having cast-in-slots defined on a lower side thereof, the slots being defined between narrow ribs in the hotplate body and the slots being arranged substantially parallel to one another;

tubular heaters including electrical heating resistors embedded in an electrical heating insulating material within a tubular metal casing, the tubular heaters being arranged in the slots, the slots engaging the heaters by at least two thirds of a circumference of the tubular heaters, whereby metallic contact is provided between the metal casing and inner surfaces of the slots;

a metal coverplate covering a lower face of the hotplate, the metal coverplate contacting the tubular heaters and pressing the tubular heaters into metallic contact with the slots;

a layer of thermal insulation provided below the metal coverplate; and, an intermediate plate disposed below the thermal insulation layer, the intermediate plate being fixed to the hotplate body and the coverplate by means of the layer of thermal insulation.

8. The electric hotplate according to claim 7, further comprising a lower coverplate shell below the coverplate, the coverplate shell being provided with thermal insulation.

* * * * *